United States Patent [19]

Widmer

[11] Patent Number: 4,671,475

[45] Date of Patent: Jun. 9, 1987

[54] RAILROAD TRACK SWITCH COVERS AND HEATER

[75] Inventor: Stanley W. Widmer, Browerville, Minn.

[73] Assignee: Stanley Widmer Associates, Staples, Minn.

[21] Appl. No.: 788,791

[22] Filed: Oct. 18, 1985

[51] Int. Cl.[4] ..... E01B 7/24; E01F 7/00

[52] U.S. Cl. ..... 246/428; 104/279; 126/271.2 B

[58] Field of Search ..... 246/428; 104/279; 246/415 R, 444; 238/8; 126/271.2 B, 271.1

[56] References Cited

U.S. PATENT DOCUMENTS

| | | | |
|---|---|---|---|
| 716,686 | 12/1902 | Dicks | 246/428 |
| 834,439 | 10/1906 | Young | 246/428 |
| 1,037,409 | 9/1912 | Baldwin | 246/428 |
| 1,153,166 | 9/1915 | Knowles | 238/8 |
| 1,325,977 | 12/1919 | Boardman | 246/428 |
| 1,661,040 | 2/1928 | Gervasio | 246/428 |
| 1,758,519 | 5/1930 | Janville | 246/428 |
| 2,067,037 | 1/1937 | Alexander | 238/8 |
| 4,093,120 | 6/1978 | Canfield | 238/8 |
| 4,391,425 | 7/1983 | Keep, Jr. | 246/428 |

*Primary Examiner*—Randolph A. Reese
*Assistant Examiner*—Scott H. Werny
*Attorney, Agent, or Firm*—Kinney & Lange

[57] ABSTRACT

A heat retaining and snow deflecting cover assembly for railroad track switches is made up of panels that prevent snow and ice from building up in the regions where the switching rails must move. An inner panel assembly is mounted between the switching rails near the entry point of the track switch. Outer panels are secured along the outer sides of the main tracks. The panels also retain heat generated by conventional heaters. Deflecting panels are secured at both ends of the inner panel assembly to guide snow inwardly to the center of the track and away from the switching rails. The cover assembly is easily installed for winter use and removed when no snow is present.

12 Claims, 11 Drawing Figures

55
25
66
67
70
71
71D
71E
71B
71A
64
62
63
68
57
52A
59
61
65
52
53
51
50
27
21
75
58
56
26
22
41

RAILROAD TRACK SWITCH COVERS AND HEATER

BACKGROUND OF THE INVENTION

1. Field of the Invention.

The present invention generally relates to railroad track switch covers to prevent accumulation of snow and ice which interferes with movement of the switching rails.

2. Description of the Prior Art.

A common and long-used method of switching trains from one set of tracks to another involves switching rails at a track switch. At the entry point of a track switch, switch rods lie beneath and are secured to the switching rails. The switching rails are connected to a track switch lever or actuator by links. When the track switch is operated, the links move laterally, causing lateral movement of the entry ends of the switching rails and thus cause the track switch to open or close. Switch rods maintain a uniform distance between the two switching rails at all times. Generally, three or more (depending on the switch length) switch rods are installed as part of the track switch.

Particularly in northern climates, movement of the switching rails is prevented by accumulation of ice and snow between the switching rails and the stationary rails of the track. During the winter, ice and snow freeze between the switching rails and the stationary rails, thus making the track switch inoperable.

A common method of preventing accumulation of ice and snow between the tracks involves trying to melt the snow with heating elements attached to the stationary rails near the switching rails. However, now such heating elements are exposed to the weather and freezing temperatures. Heat is allowed to escape; thus, operation of the system is inefficient and expensive. Furthermore, during extremely cold temperatures and windchill factors, the heat produced from low wattage elements may not be sufficient to prevent ice and snow from jamming the switching rails.

Consequently, a need exists for improvements in preventing ice and snow accumulation between switching rails and tracks which will result in greater reliability and dependability of operation at reduced levels of energy consumption.

SUMMARY OF THE INVENTION

The present invention provides an apparatus to cover switching rails and aid in preventing accumulation of snow and ice from jamming the switching rails, as well as reducing the loss of heat from switch heaters. The invention embodies a series of panels, easy to install and adaptable to present track switches, that reduce heat loss from heating elements placed near track switches. The present invention provides more efficient operation of the heating elements, resulting in a lower cost of operation to the railroad companies.

A series of inner panels are fastened to switch rods and will move with the switching rails as they are moved laterally back and forth between the switch positions. A series of outer panels is secured along the outsides of the stationary rails of the track to further protect the switch region of the track from ice and snow. Deflecting covers are placed at the leading and trailing ends of the interior panels to tend to push snow carried by trains moving along the track inwardly toward the center line of the track and keep such snow away from the switching rails.

DETAILED DESCRIPTION OF THE PREFERRED EMBODIMENTS

Figure 1:
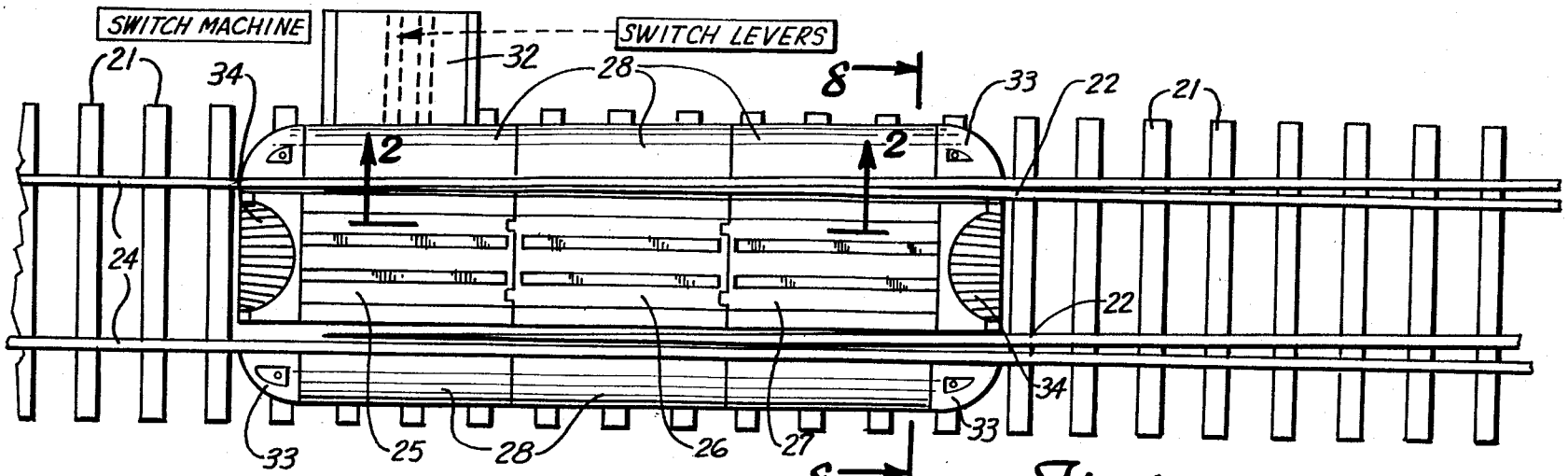
FIG. 1 is a top view of the apparatus of the present invention, showing the inner panel assembly, the outer panel assembly and the end deflectors installed on a railroad track switch.

A cover for railroad track switches indicated generally at 20, is shown in FIG. 1. Switching rails 22, used to switch a train from one set of tracks to another, lie in between the stationary rails of a track 24. The switch rails are moved laterally between switching positions. A plurality of inner panels 25, 26 and 27 are placed end to end inbetween the switching rails 22 near the entry point of the track switch. A plurality of outer panels 28 are mounted on both outer sides of the main track 24. One of the outer panels at the lead in end of the switch rails includes a lateral extension 32 to cover the connecting links from the switch lever to the switch rods. At the opposite ends of the inner panel assembly, that is, at the outer ends of the end inner panels 25 and 27, deflectors 34 are provided between the switch rails 22. Rounded corner panels 33 are placed at the outer ends of the end outer panels 28 on both sides of the main track 24.

Figure 2:
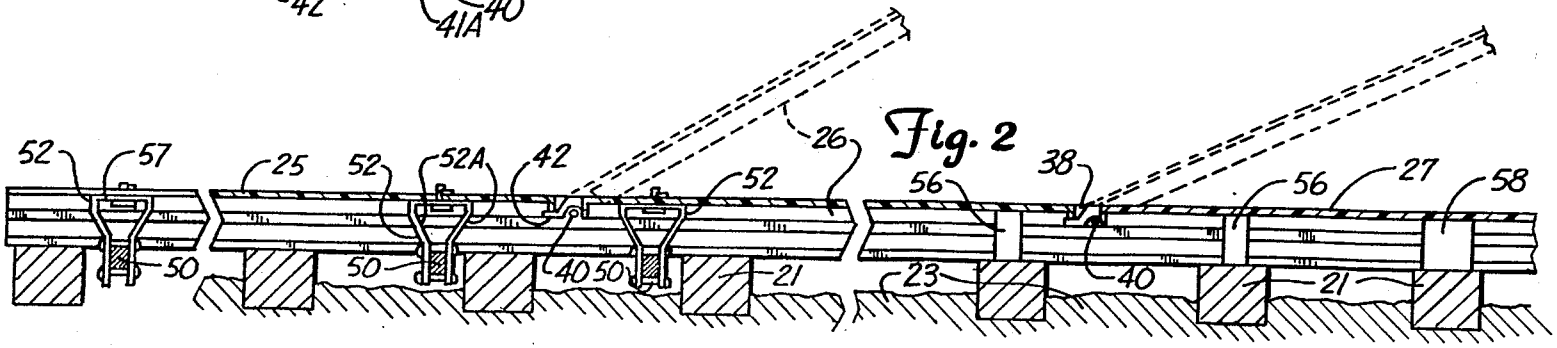
FIG. 2 is a sectional view taken at line 2—2 of FIG. 1.
Figures 4, 5, 6, 7:
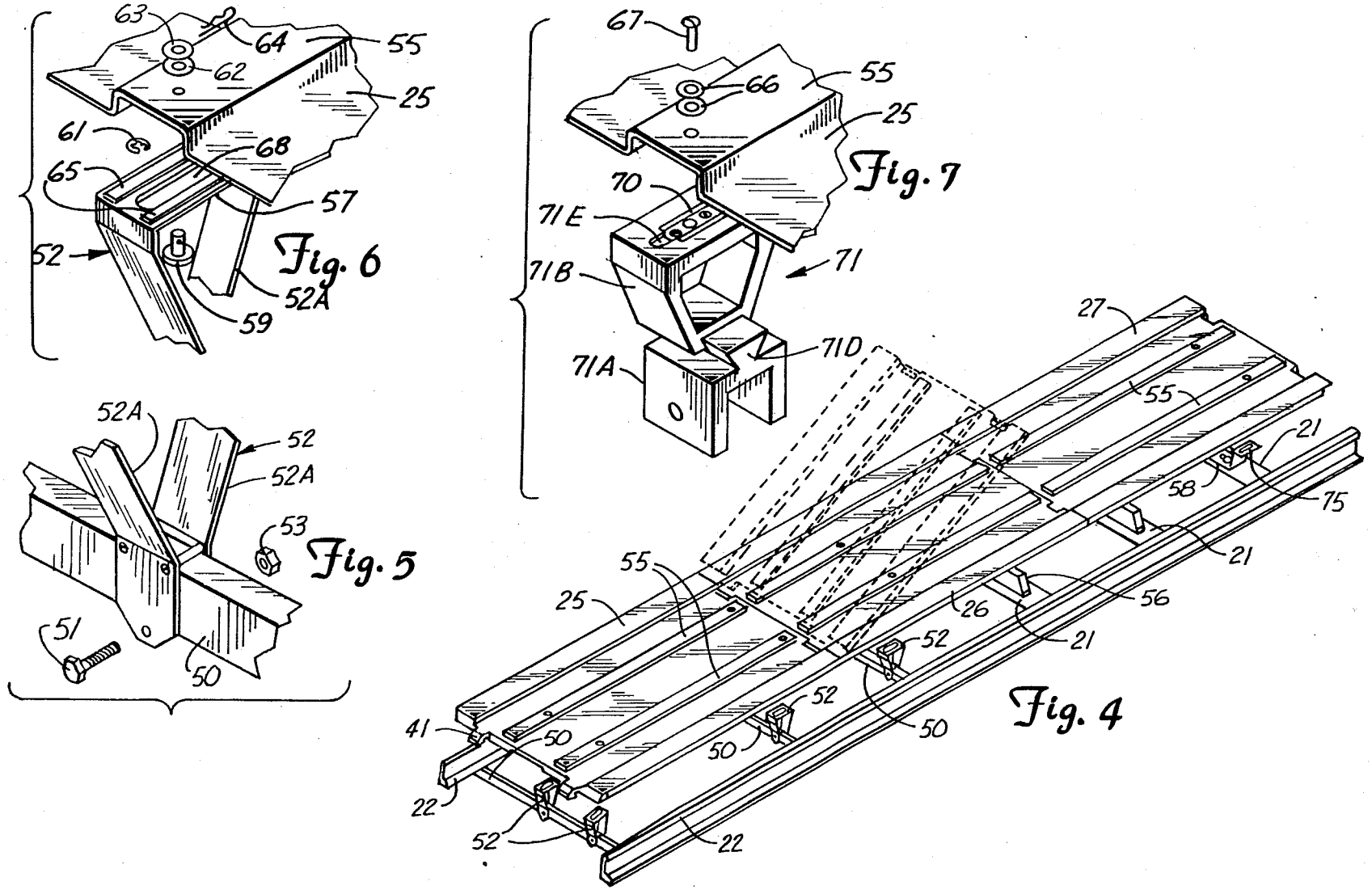
FIG. 4 is a perspective view of the inner panel assembly of the apparatus shown in FIG. 1.
FIG. 5 is an exploded perspective view of a support bracket for mounting an inner panel to a switch rod for movement therewith.
FIG. 6 is a fragmentary exploded perspective view of a support bracket and inner panel showing the fasteners used.
FIG. 7 is an exploded perspective view of a modified support arrangement for the inner panel.

As shown in the cross sectional view of FIG. 2 and the perspective view of FIG. 4, the switching rails 22 (and the stationary rails as well) rest on crossties 21, which are usually supported in a rail bed of gravel or crushed rock 23. Three switch rods 50 lie beneath, extend between, and are secured to the movable switching rails 22 near the entry point of the track switch shown. In the preferred embodiment of the apparatus 20, the three inner panels 25, 26 and 27 are placed between the switching rails 22, beginning near the entry point of the switching rails 22 and covering the switch rods 50. The inner panels 25, 26 and 27 are of a width to substantially cover the space between the switching rails 22 and the tops of the inner panels are just below the plane of the tops of the switching rails 22 and all of the inner panels lie in substantially the same plane. It is preferred that the inner panels 25–27 be constructed of a material capable of withstanding adverse weather and of supporting the weight of ice and snow. However, it is also preferred that the panels 25–27 be light enough to be manually installed and removed. Suitable plastic may be used.

Figure 3:
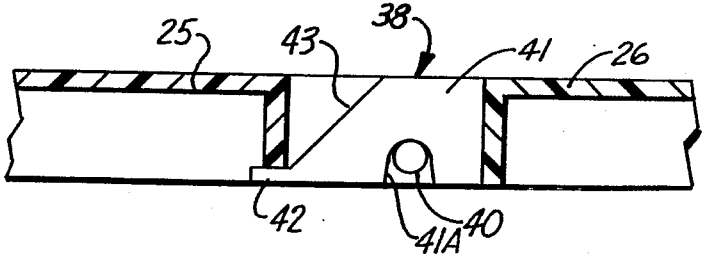
FIG. 3 is an enlarged elevational view of the hinging mechanism between adjacent inner panels shown in FIG. 2.

The inner panels 25, 26 and 27 are hingedly and removably connected to each other by interlocking hinge and docking assemblies indicated generally at 38 and shown in the detail in FIG. 3. The hinging to permit removal and separation of the panels is also shown in FIG. 2. Panel 26 is connected to panel 25 and panel 27 is connected to panel 26.

Each panel has brackets at opposite ends thereof for making the necessary fastening. As shown, each inner panel has arms 41 at one end which are notched as at 41A. The opposite end of each panel has arms or supports 43 thereon which mount pivot pins 40. When the inner panels are placed end to end the notches 41A of arms 41 will fit over an aligning pin 40 at the adjacent end of the adjacent panel. As shown, the arms 41 of panel 26 have grooves 41A mounted on pins 40 attached to the arms 43 of panel 25. The opposite end of panel 25 is attached to the first switch rail at the entry end of the switch, as shown. The arms 41 have lips 42 that extend under the edge of the adjacent panel, as shown, and when the panels are horizontal the lip 42 locks the notches of arms 41 onto the pins 40 of the adjacent panel so the panels will not separate. They are releasably locked together when the inner panels are raised as shown in dotted lines in FIG. 2, the arms 41 can be released from the associated pins 40 so the raised panel can be completely removed. However, panel 27 would have to be removed first and then panel 26.

Brackets 52 are provided for supporting the first inner panel 25 on the switch rods 50. The switch rods 50 are used to hold the switching rails 22 together so that when the switch actuator is moved, both rails 22 move laterally. The switch rods may be activated by a remote switching machine or by manual switch levers as shown schematically in FIG. 1. Brackets 52 may be connected to the switch rods 50 as shown in FIG. 5. As shown in FIG. 5, a formed and welded steel support bracket 52 having legs 52A is clamped to the switch rod 50 with a nut 53 and bolt 51. The lower portion of the brackets 52 can be made in any desired manner. For example, the lower part may be made in two sections with the legs 52A removable from a lower clamp section. Two brackets 52 are fastened to each of the switch rods 50 in spaced location to support the inner panels that overlie the switch rods 50. Panel 25 is supported on two switch rods, and thus moves with these switch rods.

The upper part of the support bracket 52 has a flat platform 57 mounted on legs 52A for supporting the respective inner panel. One way of attaching the inner panel 25 and one end of the panel 26 to the brackets 52 is shown in FIG. 6. The inner panels are provided with longitudinally extending reinforcing ribs 55, which are channel shaped in cross section, and which are integrally formed in the panels. The ribs 55 are of sufficient width to receive the platform 57 of a bracket 52. As shown, there are two of these ribs extending longitudinally along the inner panels, and two brackets 52 are used for supporting the inner panel 25 and one end of inner panel 26 on the switch rods.

The platform 57 on the top portion of the brackets 52 as shown in FIG. 6 is provided with a longitudinally extending slot 68 to accomodate dimensional variations. A headed pin 59 is passed through the slot 68, and is held onto the platform 57 with a retaining ring 61 that holds the pin 59 in position in the slot, regardless of whether or not an inner panel is fastened in place. In other words, the retainer ring 61 is just above the platform 57, and the outer end of the pin extends upwardly from the platform. As shown there are foam rubber strips 65 mounted parallel to the slot 68 on opposite sides thereof and fixed to the platform 57. The retaining ring 61 will fit between these foam strips, and hold the pin 59 in place.

The ribs 55 are provided with openings that are positioned to receive the outer ends of the pins 59, which extend through the openings above the surface of the inner panel. The ribs fit over the platform 57. A rubber washer 62 is placed over the upper panel surface, around the end of the pin 59. A plain washer 63 is put over the rubber washer 62 and a retaining clip 64 is passed through an opening in the pin 59 to thus hold the panel in place on the stud.

The panels can slide relative to the platform 57 in direction of the longitudinal axis of the slot 68, but will be moved laterally with the switch rods when the switch rods are moved.

In FIG. 7, an alternate bracket and an alternate form of fastening the inner panels onto the support brackets is shown. A two piece support bracket 71 is shown comprising a lower extendable section 71A that fastens onto a switch rail. The lower section 71A can be made with side legs of different lengths for height adjustment. An upper section 71B is an extended standard part that has a dovetail connector 71C interfitting with a corresponding part 71D on the lower section 71A. Thus, if height adjustment is needed different lower sections can be used and the upper section merely dovetailed in place.

The interfitting dovetail sections permit slipping the two bracket parts together easily so different ones of the lower bracket section can be used if a different height is needed. The bracket sections can be extended for low cost.

A slider assembly 70 is placed in a slot 71E of the upper section 71B. The slider assembly 70 comprises two formed bracket parts, one above and one below the platform, held together with suitable screws, and having offset edges that permit the slider assembly to slide along the slot 71E. The slider assembly 70 has a central opening into which a stud 67 can pass. The stud 67 passes through suitable spacers 66, then through the upper wall of the inner panel in the area of rib 55, and then through the opening in the center of slider assembly 70. The stud 67 can be held in place with a suitable retainer.

The bracket parts of slider assembly 70 can be tightened and thus clamped into place if desired after the unit has been assembled, but the slider assembly must slide in the slot 71E initially for alignment purposes when the panels are to be installed.

The first inner panel 25 is supported on four brackets 52 or 71. There are two brackets 52 or 71 on each of the first two switch rods 50 near the entry point of the track switch. The panel 25 is fastened to the brackets as shown in either FIGS. 6 or 7. The adjacent (entry) end of the second inner panel 26 is supported by brackets 52 or 71 on a third switch rod 50. Sliding supports 56 are provided to support the remote or opposite end of the second inner panel 26 and the leading or entry end third inner panel 27 adjacent panel 26. Each support 56 is merely a spacer block secured to an appropriate crosstie 21 beneath the inner panels 26 and 27. In the preferred embodiment, the panel supports 56 are secured to the crossties 21 with lag bolts (not shown). The supports 56 are of sufficient height so that the panels 26 and 27 are properly positioned when they are resting on the top surfaces of the supports 56. The top surfaces of the supports 56 are smooth to allow sliding of the panels 26 and 27 as the switching rails 22 are actuated. Thus, the supports 56 do not fit into the recess formed by ribs 55.

Figure 8:
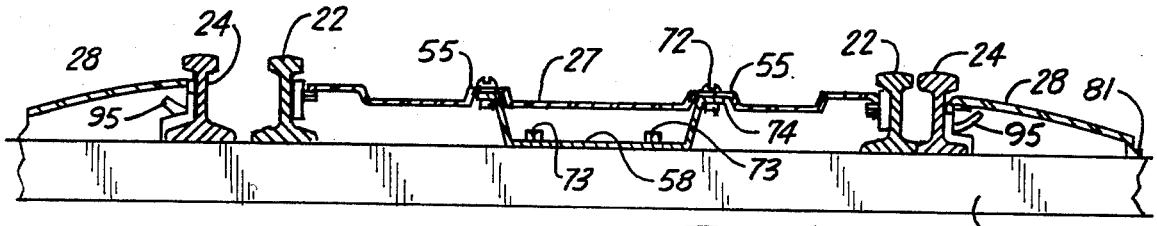
FIG. 8 is a sectional view taken at line 8—8 of FIG. 1.

An end bracket 58 supports the remote end of the third inner panel 27 for pivoting as the switching occurs. As can be seen in FIG. 8, the bracket 58 is secured by bolts 73 on a suitable crosstie 21 lying beneath that end of the third inner panel 27. The bracket 58 includes two support wings 74 that are spaced above the crosstie and each of which recieves a pin 72 which passes through an opening in the inner panel 27 and connects the panel 27 to the bracket 58. As shown in FIG. 4, a longitudinal slot 75 is provided in each wing 74 of the bracket 58 to allow for adjustments during installation. Also, the pins 72 may slide in the slot 75 to allow for slight pivoting movement of the remote end of third panel 27 when the switching rails 22 are actuated and panels 25, 26 and 27 have to move with the switching rods.

Figure 11:
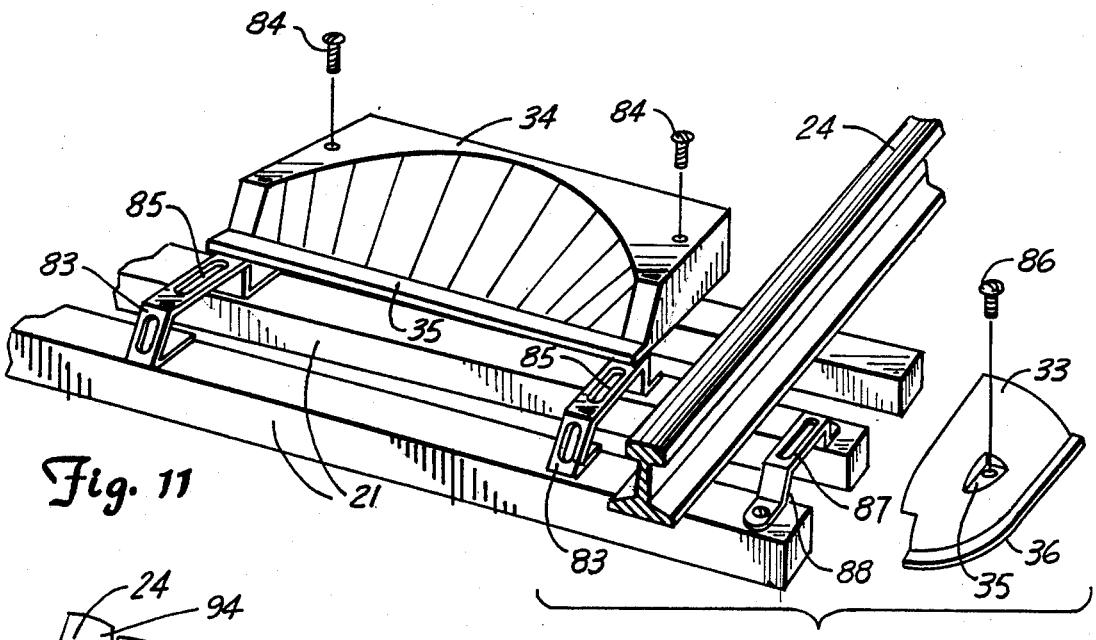
FIG. 11 is an exploded perspective view of a center deflector panel and corner panel of the apparatus shown in FIG. 1.
Figure 9:
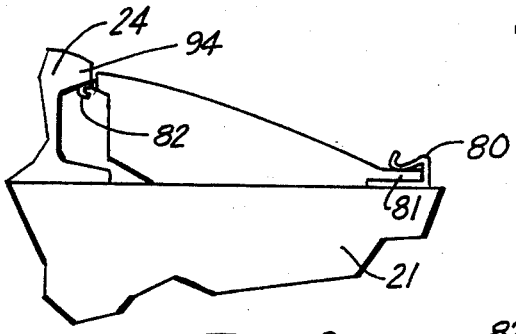
FIG. 9,is a detailed end view of an outer panel mounted to the utside of the track rails.
Figure 10:
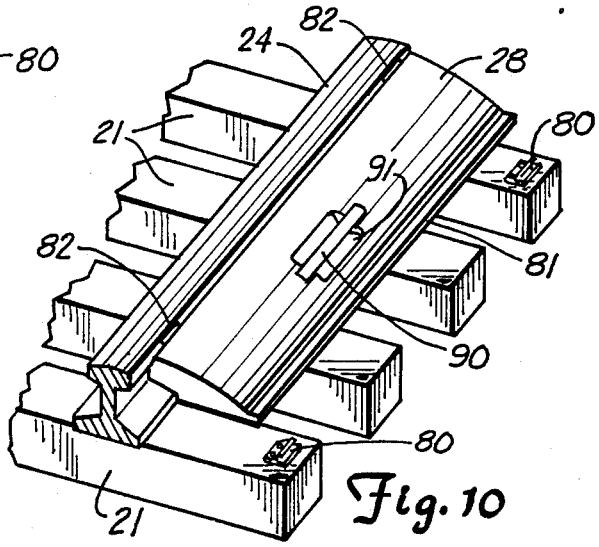
FIG. 10 is a fragmentary perspective view showing an outer panel mounted against the outside of a track rail.

Outer panels 28 are secured against the outside edges of the stationary rods of track 24 which rails do not move during switching. As perhaps best seen in FIGS. 9 and 10, clips 82 are fastened along the upper inside edge of each outside panel 28 to hold the panel 28 in place beneath the upper shoe 94 of the rail of the main track 24. FIG. 9 shows a bottom outer edge lip 81 of the outer panel 28 which is secured to the crossties by a clip 80. As shown in FIG. 11, at least two clips 80 for each panel 28 are placed on selected crossties 21 to receive an outer edge lip 81 of each of the outer panels 28.

Handles 90 may be provided on the outer panels 28 for ease of installation and transportation. A cutout 91 in the panel allows for the grasping such handle 90 after it is placed over the cutout 91. So as to reduce the possibility of snagging a passing object, it is preferred that handle 90 be substantially at, or recessed below the surface of the panel 28.

FIG. 11 shows a deflector panel 34, one of which is used at each of the opposite ends of the inner panel assembly 25–27 between the switching rails 22. Each deflector panel 34 has a concave, upwardly and inwardly tapering surface 36 which extends from a lower outside edge lip 35 of the panel 34 to the edge which joins the entry end of inner panel 25 on the entry end of the switch and which joins the remote end of panel 27 at the other end of the inner panel assembly. The concave tapering causes snow and ice to move inwardly and away from the switching rails 22 and tracks 24 as a train passes over. Two brackets 83 are fastened to appropriate crossties 21 beneath the deflector panel 34 for holding the deflector panels in place. A longitudinal slot 85 in each bracket 83 allows for reception of a retaining screw 84. The slot 85 permits adjustments when the panel 34 is installed.

Remote corner panels 33 are provided at the ends of the outer panel assemblies 28 and aligning with the deflecting panels to fill the corners. Corner panels 33 are each secured along the outside of the main track 24 by means of a screw 86 which passes through the panel 35 and into a longitudinal oval slot 87 of a bracket 88. Cutouts 35 in the panel 33 provides a flat surface for the head of the screw 86. The bracket 88 is secured to appropriate crossties 21 beneath the corner panel 33. The panels 33 are rounded and tapered upwardly from the outside lip 36 so as to provide a smooth surface for deflecting snow and ice.

Covering railroad track switches in the area between the switching rails 22 is done with inner panels 25–27 to prevent exposure to the weather and to retain heat emitted from electric heating elements 95 placed along the sides of the tracks 24 as shown in FIG. 8. The heaters can be placed in desired locations, such as between the ties under the switch rods, and are conventionally used. However, with the panels shown herein the effectiveness of the heaters is multiplied. The outer panels 28 also retain heat generated by the heating elements, and further shield the tracks from snow.

Brackets 52 or 71 are aligned to receive inner panels 25 and 26 and secured to switch rods 50. The first inner panel 25 is fastened to brackets 52 or 71 secured to the first two switch rods 50 of the track switch. The brackets 52, having platform supports 57, are aligned so that the platforms 57 fit under ribs 55 of the inner panel 25.

A second inner panel 26 is joined to the first inner panel 25 by a connecting mechanism 38 as shown which locks the two inner panels together and holds them in place, while permitting removal of the panels easily when the free ends are pivoted up as shown in FIG. 2.

In addition to the inner panels, the outer panels and the end deflector panels described also provide shielding. The corner outer panels 33 merge in and align with the end panels and deflector panels as well. The corner panels are rounded to tend to deflect dragging chains and cables carried by trains, and to shed snow and keep it away from the switching rails, which must be able to move laterally for switching.

After installation, the inner panels 25 and 26, which are fastened to switch rods, move laterally with the switch rods when the switching rails 22 are actuated. The third inner panel 27 is connected at its far end to a crosstie 21 by the end bracket 58. The slots 75 in the wings 74 of the bracket 58 allow for some angular movement of the third panel 27 when the switching rails 22 are actuated.

The deflector panel 34 and corner panel 33 are tapered and rounded to push snow and ice away from the switching rails 22. The rail shoes are left exposed upwardly so train wheels can roll over them, and so the switch will work.

The inner panels 25–27, outer panels 28 and the deflector panels 34 and corner panels 33 retain heat emitted by heating elements installed along tracks 24 at track switches. In the preferred embodiment, all panels must be made of materials of sufficient strength to withstand adverse weather and objects such as chains dragged by passing trains. The ribs 55 can be separate and attached to the panels, or when sheet molding compound is used and the panels are molded, the ribs can be integrally formed, as shown.

Although the present invention has been described with reference to preferred embodiments, workers skilled in the art will recognize that changes may be made in form and detail without departing from the spirit and scope of the invention.

What is claimed is:

1. In a railroad track switch for switching trains from one set of tracks to another, having main tracks, crossties supporting the tracks, switching rails which move laterally between the main tracks, switch rods connected to the switching rails for laterally moving the switching rails between switching positions, the switch having an entry end, the improvement comprising an apparatus to cover the track switch including:

(a) an inner panel assembly secured between the switching rails adjacent the entry end;

(b) an outer panel assembly secured along the outside edges of the main tracks adjacent the entry end; and (c) deflecting cover means secured at both ends of the inner and outer panel assemblies of said cover means including concave and upwardly inclined surfaces configured for deflecting materials moving in a direction along the rails to be urged and deflected away from the switching rails.

2. The apparatus of claim 1 wherein said inner panel assembly includes:

(a) a plurality of individual inner panels placed end to end, near the entry end of the switch and extending a substantial distance beyond the switch rods; and (b) means for fastening the individual inner panels placed above the switch rods to the switch rods so that such panels move laterally back and forth with the switching rails when the switching rails are actuated to the respective switch positions.

3. The apparatus as specified in claim 2 and means for pivotally mounting the separate individual inner panel at the remote end of the remote inner panel assembly opposite the switch entry end to a crosstie lying beneath the remote end of the individual inner panel, so that the panel assembly pivots when the inner panels connected to switch rods move laterally, and means for slidably supporting portions of all intermediate individual inner panels between the pivotal mounting of the remote end of the remote individual panel and the individual inner panels adjacent the entry end which are fastened to switch rods so that the intermediate individual inner panels slide on the slidably supporting means as the switching rails are moved.

4. An inner panel assembly as recited in claim 3 including means for releasably joining the adjacent ends of the individual inner panels to each other.

5. The apparatus of claim 4 wherein the adjacent individual inner panels are hingedly connected together, and the hinges are releasable when one panel has pivoted a predetermined amount relative to an adjacent panel.

6. In a railroad track switch for switching trains from one set of tracks to another, having main tracks, crossties supporting the tracks, switching rails which move laterally between the main tracks, switch rods connected to the switching rails for laterally moving the switching rails between switching positions, the switch having an entry end, the improvement comprising an apparatus to cover the track switch including:

(a) an inner panel assembly secured between the switching rails adjacent the entry end;

(b) an outer panel assembly secured along the outside edges of the main tracks adjacent the entry end; and (c) deflecting cover means secured at both ends of the inner and outer panel assemblies comprising deflector panels placed between the switching rails at opposite ends of the inner panel assembly, said panels being tapered concavely and upwardly from the outside of the respective deflector panel to the center thereof to tend to urge material moving in direction along the track toward the center of the track and away from the rails.

7. An apparatus as specified in claim 6 wherein the outer panel assembly comprises:

(a) a plurality of individual outer panels, each tapered upwardly from an outside edge to an inside edge which is of size to fit immediately below the top of a rail forming the main track; and (b) means for securing the individual outer panels against the outside edges of the adjacent rail of the main track.

8. The apparatus of claim 6 wherein said deflecting means includes corner panels at the corners formed between the deflector panels and the outer panels, said corner panels being rounded and tapered upwardly from outer edges to inside edges.

9. A cover assembly for a railroad track switch which includes switching rails and a track formed of stationary rails mounted on crossties of a rail bed comprising:

(a) first panel means having means for securing the panel means between switching rails of a track switch and having an upper surface substantially at a level of such switching rails for keeping snow away from the region between such switching rails;

(b) second panel means adapted for mounting on outer sides of stationary rails used in such a track switch and which taper upwardly from a lower edge spaced from the respective stationary rails of a track switch on which the second panel means are mounted to an upper edge of height to be substantially contiguous with such stationary rails when mounted and substantially at the level of the tops of such rails for shielding the stationary rails from snow;

(c) clip means adapted to be mounted onto crossties of a rail bed for removably holding the second panel means in position; and (d) a handle mounted on portions of each of the second panel means, the handle being mounted so as to be substantially at or below the adjacent surface of the second panel means.

10. The cover assembly of claim 9 and heater means mounted on at least said stationary rails below the level of the upper surfaces of said track.

11. The apparatus of claim 9 and second clip means secured on edges of the second panel means which engage the associated tracks and hold the second panel means against the associated track to restrict upward movement of the second panel means.

12. The apparatus as specified in claim 9 wherein said first panel means have ribs formed therein and running in a direction longitudinal to the track, and support means for the first panel means which are received in the lower side of the formed ribs.

* * * * *